United States Patent [19]

Krafft

[11] 4,440,849

[45] Apr. 3, 1984

[54] DYE DIFFUSION TRANSFER PROCESS WITH DEVELOPMENT ACCELERATORS

[75] Inventor: Werner Krafft, Leverkusen, Fed. Rep. of Germany

[73] Assignee: Agfa-Gevaert Aktiengesellschaft, Leverkusen, Fed. Rep. of Germany

[21] Appl. No.: 390,262

[22] Filed: Jun. 21, 1982

[30] Foreign Application Priority Data

Jun. 26, 1981 [DE] Fed. Rep. of Germany ..... 3125058

[51] Int. Cl.[3] ..... G03C 5/54; G03C 1/40; G03C 5/30

[52] U.S. Cl. ..... 430/239; 430/218; 430/487

[58] Field of Search ..... 430/218, 239, 223, 487

[56] References Cited

U.S. PATENT DOCUMENTS

| | | | |
|---|---|---|---|
| 2,983,606 | 5/1961 | Rogers | 430/218 |
| 3,846,129 | 11/1974 | Kuh | 430/222 |
| 4,030,920 | 6/1977 | Kuh et al. | 430/218 |
| 4,139,379 | 2/1979 | Chasman et al. | 430/223 |
| 4,232,107 | 11/1980 | Janssens | 430/223 |
| 4,353,975 | 10/1982 | Janssens et al. | 430/218 |

OTHER PUBLICATIONS

"Photographic Processes and Products", *Research Disclosure* #15162, 11/1976, pp. 75–87.

*Primary Examiner*—Richard L. Schilling
*Attorney, Agent, or Firm*—Connolly & Hutz

[57] ABSTRACT

The invention relates to a process for the production of colored images by the dye diffusion transfer principle, in which a color photographic recording material containing negative silver halide emulsions and reducible color-providing compounds is developed with an alkaline developer preparation containing a combination of at least one compound from each of at least two of the groups of compounds (A, B, C) defined below as development accelerators. With combinations of this type, equal or higher maximum color densities are obtained for a smaller overall quantity of development accelerator.

A: a 1,3-diol containing from 3 to 10 carbon atoms

B: a cyclohexane dimethanol or cyclohexene dimethanol

C: an aryl alkanol or aroxyalkanol containing from 7 to 12 carbon atoms.

4 Claims, No Drawings

DYE DIFFUSION TRANSFER PROCESS WITH DEVELOPMENT ACCELERATORS

This invention relates to a process for producing a colored image by the dye diffusion transfer process using non-diffusing color-providing compounds (dye releasers), in which higher color densities and, more particularly, more uniform development of the three component colors yellow, magenta and cyan are obtained by using a special combination of development accelerators in the alkaline developer preparation.

Among the hitherto known processes for the production of colored photographic images by the dye diffusion transfer process, increasing importance has recently been attributed to those processes which are based on the use of color-providing compounds incorporated in non-diffusible form from which diffusible dyes of dye precursors are split off imagewise during development and transferred to an image-receiving layer. These non-diffusing color-providing compounds (dye releasers) are divided into those of the type which function negatively, i.e. which give negative dye transfers with usual negative silver halide emulsions, and those of the type which function positively.

The latter compounds contain a carrier residue which comprises a ballast group and a redox portion and which is built up in such a way that a diffusible image dye attached to it is released more or less in inverse proportion to the stage of development of the silver halide layer under alkaline conditions. Accordingly, the system in question is one which functions positively from the outset and which is suitable for the production of positive images using conventional negative silver halide emulsions. The present invention relates to a process in which dye releasers functioning in this way are used.

Dye diffusion transfer processes using non-diffusing color-providing compounds (dye releasers) are frequently attended by the problem that the dye transfer images obtained after the short development time required are unsatisfactory both in regard to the color densities obtained and in regard to the color balance. In other words, the maximum color density and gradation of the individual component color images are extremely difficult to bring into line in the short development time. In order to overcome this disadvantage, various compounds may be added to the developer preparation as development accelerators. Several such compounds are described in Research Disclosure 15162 (November 1976).

In addition, it is known that, when used in a developer preparation, saturated aliphatic and cycloaliphatic diols or saturated amino alcohols and mixtures thereof intensify the degree of contrast when the color photographic recording material contains unfogged direct-positive silver halide emulsions ("internal image emulsions") in combination with so-called redox dye releasers and is developed in the presence of a fogging agent (U.S. Pat. No. 4,030,920).

An object of the present invention is to produce colored images by the dye diffusion transfer process in such a way that as high a maximum dye transfer as possible is obtained in as short a development time as possible using as small a quantity of development accelerator as possible. Another object of the invention is to enable the individual component color images yellow, magenta and cyan to be brought into better consistency with one another in regard to maximum color density and contrast.

SUMMARY OF THE INVENTION

The present invention thus provides a process for the production of coloured images by the dye diffusion transfer process, in which an imagewise exposed color photographic recording material, comprising at least one photosensitive silver halide emulsion layer and, associated therewith, a non-diffusing color-providing compound, is developed in surface-to-surface contact with an image-receiving layer using a developer preparation containing a development accelerator, characterized in that 1. a color photographic recording material is used which, in association with at least one negative silver halide emulsion layer, contains a combination of a non-diffusing reducible color-providing compound and an ED-compound, and in that
2. a developer preparation is used which contains as development accelerator a combination of at least two of the compounds A, B and C defined in the following, of which
   - A is an aliphatic 1,3-diol containing from 3 to 10 carbon atoms,
   - B is a cyclohexane dimethanol or a cyclohexene dimethanol, and
   - C is an aryl alkanol or an aroxyalkanol containing from 7 to 12 carbon atoms.

DETAILED DESCRIPTION OF THE INVENTION

Under alkaline development conditions, the reducible dye releasers used in accordance with the invention release a diffusible dye by reduction or in consequence of reduction. Reducible dye releasers are described in DE-OS No. 28 09 716, DE-OS No. 30 588, DE-OS No. 30 14 669, EP-A No. 0 004 399 and GB-A No. 80 12 242. Reducible dye releasers particularly preferred for the purposes of the invention correspond to the following formula I

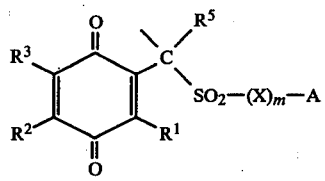

(I)

in which $R^1$ represents alkyl or aryl;

$R^2$ represents alkyl, aryl or a group which, together with $R^3$, completes a fused ring;

$R^3$ represents hydrogen, alkyl, aryl, hydroxyl, halogen, such as chlorine or bromine, amino, alkylamino, dialkylamino, including cyclic amino groups (such as piperidino or morpholino), acylamino, alkylthio, alkoxy, aroxy, sulfo or a group which, together with $R^2$, completes a fused ring;

$R^4$ represents alkyl;

$R^5$ represents alkyl or preferably hydrogen;

A represents the residue of a diffusible dye or dye precursor;

X represents a divalent radical corresponding to the formula $—R—(L)_p—(R)_q—$ in which R represents an alkyl radical containing from 1 to 6 carbon atoms or an optionally substituted arylene or aralkylene radical, and two radicals R may be the same or different;

L represents —O—, —CO—, —CONR$^6$—, —SO$_2$—NR$^6$, —O—CO—NR$^6$—, —S—, —SO— or —SO$_2$— (R$^6$ represents hydrogen or alkyl);

p=0 or 1;

q=0 or 1;

m=0 or 1;

at least one of the radicals R$^1$, R$^2$, R$^3$ and R$^4$ containing a radical which imparts resistance to diffusion.

The alkyl radicals represented by R$^1$, R$^2$, R$^3$ and R$^5$ in formula I may be linear or branched and generally contain up to 18 carbon atoms. Examples are methyl, n-propyl, t-butyl, tetradecyl and octadecyl. The aryl radicals represented by R$^1$, R$^2$ and R$^3$ are, for example, phenyl group which may be substituted, for example by long-chain alkoxy groups.

In an acylamino radicals represented by R$^3$, the acyl groups is derived from aliphatic or aromatic carboxylic or sulfonic acids. The fused rings completed by R$^2$ and R$^3$ are preferably carbocyclic rings, for example fused benzene or bicyclo [2,2,1] heptene rings.

An alkyl radical represented by R$^4$ may be linear or branched, substituted or unsubstituted and may contain up to 21 carbon atoms. Examples are methyl, nitromethyl, phenylmethyl (benzyl), heptyl, tridecyl, pentadecyl, heptadecyl and —C$_{21}$H$_{43}$.

Preferred embodiments of the dye donors used in accordance with the invention are those in which R$^1$, R$^2$ and R$^3$ in a quinoid carrier radical together contain no more than 8 carbon atoms and, more particularly, no more than 5 carbon atoms, and R$^4$ represents an alkyl radical containing at least 11 carbon atoms.

Other preferred embodiments are those in which R$^1$ represents an alkoxyphenyl radical containing at least 12 carbon atoms in the alkoxy group and R$^2$, R$^3$ and R$^4$ together contain no more than 8 carbon atoms.

Radicals which impart resistance to diffusion are understood to be radicals of the type which enable the compounds according to the invention to be incorporated in diffusion-resistant form in the hydrophilic colloids normally used in photographic materials. Preferred radicals of this type are organic radicals which in general contain linear or branched aliphatic groups generally containing from 8 to 20 carbon atoms and, optionally, carbocyclic or heterocyclic, optionally aromatic groups. These radicals are attached to the remainder of the molecule either directly or indirectly, for example through one of the following groups: —NHCO—, —NHSO$_2$—, —NR— (R=hydrogen or alkyl), —O— or —S—. In addition, the radical which imparts resistance to diffusion may also contain water-solubilizing groups such as, for example, sulfo groups or carboxyl groups which may even be present in anionic form. Since the diffusion properties depend upon the size of the molecule of the compound used, it is sufficient in certain cases, for example if the total molecule used is large enough, to use even relatively short chain radicals as the "radicals imparting resistance to diffusion".

Accordingly, the dye releasers preferably used in accordance with the invention contain per dye residue A one releasable quinoid carrier radical imparting resistance to diffusion and corresponding to the following formula

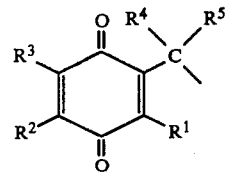

"carquin"

in which R$^1$, R$^2$, R$^3$, R$^4$ and R$^5$ are as already defined.

Suitable dye residues are, in principle, the residues of dyes of any class providing they are sufficiently diffusible to be able to diffuse through the layers of the photosensitive material into the image-receiving layer. To this end, the dye residues may be provided with one or more alkali-solubilising groups. Suitable alkali-solubilizing groups are inter alia carboxyl groups, sulfo groups, sulfonamide groups and aromatic hydroxyl groups. Alkali-solubilizing groups of this type may already be preformed in the dye releasers used in accordance with the invention or may emanate from the release of the dye residue from the carrier radical containing ballast groups. Dyes which are particularly suitable for use in the process according to the invention include azo dyes, azomethine dyes, anthraquinone dyes, phthalocyanine dyes, indigoid dyes and triphenyl methane dyes, including dyes of the type which are complexed or capable of being complexed with metal ions.

Residues of dye precursors are understood to be the residues of compounds which are converted into dyes in the course of photographic processing by standard or additional processing steps, whether by oxidation, by coupling, by complexing or by the liberation of an auxochromic group in a chromophoric system, for example by hydrolysis. Dye precursors in this sense may be leuco dyes, couplers or even dyes which are converted into other dyes during processing. Providing it is not crucially important to differentiate between dye residues and the residues of dye precursors, residues of dye precursors are also intended to be understood in the following as dye residues.

The reducible dye releasers cleavable in reduced form are used together with so-called electron donor compounds (ED-compounds) in the process according to the invention. Electron donor compounds act as a reducing agent which is consumed imagewise during development of the silver halide and of which the unused portion in turn reduces the associated dye releaser and, in doing so, effects the release of the dye. Suitable ED-compounds are, for example, non-diffusing or only slightly diffusing derivatives of hydroquinone, benzisoxalone, p-aminophenol or ascorbic acid (for example ascorbyl palmitate), which are described, for example, in DE-OS No. 28 09 716. Other suitable ED-compounds are described in DE-OS No. 29 47 425. According to the invention, the ED-compounds may also be present in a masked form as so-called ED-precursor compounds which, although not themselves acting as reducing agents with respect to silver halide or reducible color-providing compounds, are converted into the actual ED-compounds under the alkaline development conditions.

ED-compounds of this type are described, for example, in Research Disclosures 19 429 (June 1979) and 19507 (July 1979) and in DE-OS No. 30 06 268.

ED-precursor compounds preferably used in the process according to the invention correspond to the following general formula (II)

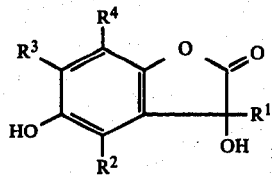

(II)

in which $R^1$ represents a carbocyclic or heterocyclic aromatic ring;

$R^2$, $R^3$ and $R^4$ are the same or different and represent hydrogen, alkyl, alkenyl, aryl, alkoxy, alkylthio, amino or $R^3$ and $R^4$ together complete a fused ring, more particularly a carbocyclic ring, at least one of the substituents $R^1$, $R^2$, $R^3$ and $R^4$ containing a $C_{10}$–$C_{22}$-ballast radical which impedes diffusion.

An aromatic ring represented by $R^1$ in formula II may be a carbocyclic ring, for example a phenyl, napthyl or anthracene group, or a 5-membered or 6-membered heterocyclic ring containing at least one of the heteroatoms N, O or S as a ring member, for example an imidazolyl, thienyl, oxazolyl, pyrryl or pyridyl group. The carbocyclic and heterocyclic aromatic rings may be unsubstituted or substituted once or several times and may contain fused carbocyclic or heterocyclic rings which, in this case, do not have to be aromatic.

Substituents on the aromatic rings represented by $R^1$ and on rings optionally fused thereto are, for example, halogen, such as fluorine, chlorine, bromine or iodine, hydroxy, sulfo, sulfamoyl, trifluoromethyl sulfonyl, amino, nitro, cyano, carboxy, carbamoyl, alkoxycarbonyl, alkyl, alkenyl, cycloalkyl, more particularly cyclohexyl or cyclopentyl, aryl, more particularly phenyl, or heterocyclic groups; the last of the above-mentioned groups (alkyl to heterocyclic groups) may contain further substituents, for example those of the type mentioned above, and the above-mentioned alkyl, alkenyl, cycloalkyl, aryl and heterocyclic groups may be attached either directly or through one of the following divalent radicals: —O—, —S—, —$SO_2$—, —$SO_2$—NR—, NR—$SO_2$—, —NR—CO—, —CO—NR—, —NR—COO—, —O—CO—NR—, —NR—CO—NR— (R=hydrogen or alkyl).

The alkyl or alkenyl groups present in formula II in the radicals represented by $R^2$, $R^3$, $R^4$ or in the substituents present in the aromatic ring represented by $R^1$ may be linear or branched and may contain from 1 to 22 carbon atoms.

An amino group represented by $R^2$, $R^3$ or $R^4$ or present as a substituent in $R^1$ corresponds to the following formula

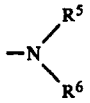

in which $R^5$ and $R^6$ are the same or different and represent hydrogen, alkyl or aryl or the ring members required to complete a 5-membered or 6-membered cyclic amino group (for example pyrrolidino, piperidino or morpholino).

All the substituents present in the ED-compound are of such a nature that the ED-compound may be incorporated in a diffusion resistant form into photographic layers. To this end, for example, at least one of the substituents present, for example at least one of the radicals $R^1$, $R^2$, $R^3$ and $R^4$, or a substituent on a ring completed by at least two of the above-mentioned radicals, for example by $R^3$ and $R^4$, contains a radical imparting resistance to diffusion. Incorporation of the ED-precursor compound in diffusion-resistant form is particularly desirable because these compounds are used in certain quantitative ratio to the associated dye releasers which is intended to remain substantially the same, even in the event of prolonged storage of the photographic recording material.

The ED-precursor compounds of formula II preferably used in accordance with the invention are, for example, the subject of DE-OS No. 30 06 268. The following are examples of ED-precursor compounds preferably used in accordance with the invention:

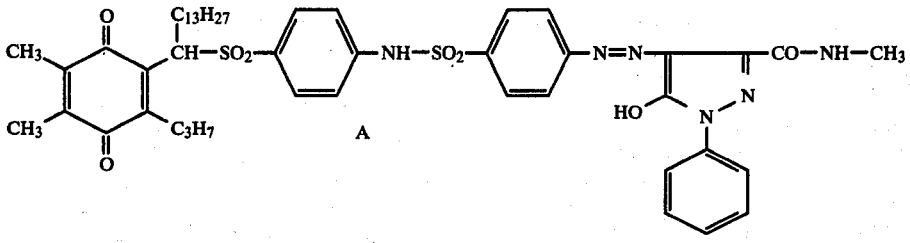

A

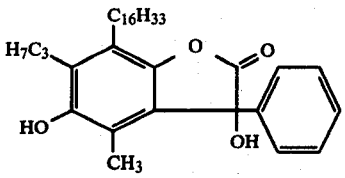

B

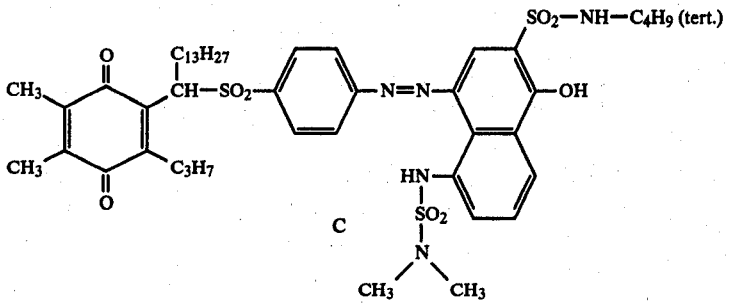

C

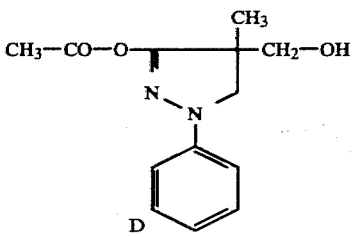

D

-continued

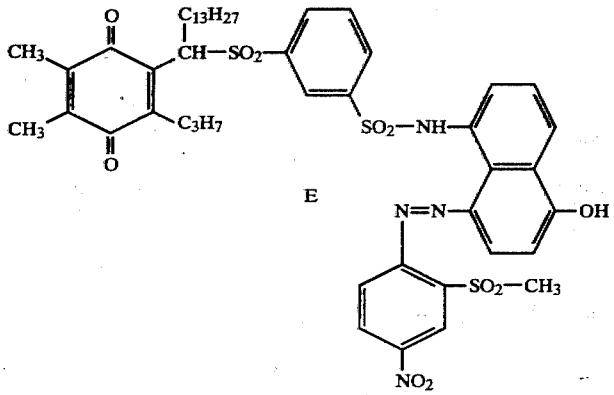

E

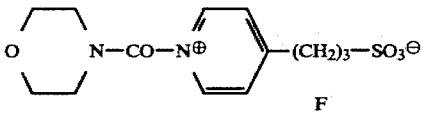

F

The color photographic recording material processed by the process according to the invention generally contains three image-producing layer units, each of which contains at least one photosensitive silver halide emulsion layer and, associated therewith, a combination of a diffusing reducible color-providing compound (dye releaser) and an ED-compound (or ED-precursor compound). One of the layer units is predominantly sensitive to blue light, another to green light, and a third to red light, the associated dye releasers respectively yielding image dyes of complementary color.

In the context of the invention, "association" and "associated" are understood to mean that the mutual arrangement of the silver halide emulsion, the ED-compound or ED-precursor compound and the dye releaser is such as to allow between them an interaction which, on the one hand, provides for imagewise consistency between the silver image formed and the consumption of ED-compound and which, on the other hand, allows a reaction to take place between the unused ED-compound and the color-providing compound so that an imagewise distribution of diffusible dye is obtained in consistency with the undeveloped silver halide. To this end, photosensitive silver halide and the combination of dye releaser and ED-compound do not necessarily have to be present in the same layer. They may even be accommodated in adjacent layers each belonging to the same layer unit.

However, to guarantee adequate interaction between the dye releaser and the associated ED-compound, it is advisable to accommodate these two compounds of a combination in the same layer, which does not have to be identical with the associated silver halide emulsion layer. The ED-precursor compounds preferably used in accordance with the invention are stable to hydrolysis under neutral conditions and, hence, are also unaffected by oxidation. This makes them particularly suitable for use together with the dye releaser in a common emulsate.

The dye releaser and ED-compounds may be incorporated by any of the methods by which hydrophobic compounds are normally incorporated in photographic layers. In other words, it is possible to use the usual emulsification techniques, for example methods in which photographic auxiliaries are added to the casting solutions in the form of emulsates using so-called oil formers. In this connection, it is best to avoid methods in which the use of alkali is unavoidable.

In general, the dye releaser is used in a layer in a quantity which is sufficient to produce a dye image having the highest possible maximum color density, for example in a quantity of from 1 to $20.10^{-4}$ moles/$m^2$. The quantity in which the ED-compound (or ED-precursor compound) is used is adapted to the quantity in which the dye releaser is used. It should be large enough to obtain as high a maximum colour density as possible, i.e. to enable the dye releaser to be reduced as completely as possible. On the other hand, it should not be significantly higher than is necessary for that purpose, so that, over the exposed areas, the reducing agent may be used as completely as possible through the development of the exposed silver halide. The most favourable quantitative ratios between the silver halide, the ED-compound and the dye releaser in each individual case are best determined by routine tests. Useful results may be obtained, for example, when the ED-compound is present in between 0.5 and 5 times the molar quantity, based on the dye releaser. The suitable quantitative ratio between the silver halide and the associated dye releaser is of the order of 2 to 20 moles of silver halide per mole of dye donor.

To obtain positive dye transfer images, the non-diffusing reducible color-providing compounds are used in combination with negative silver halide emulsions. In principle, any standard negative emulsions may be used for this purpose providing they can be developed sufficiently quickly. The emulsions may contain silver chloride and silver bromide as the silver halide, optionally with a silver iodide content of up to 10 mole percent. Suitable emulsions are, for example, emulsions of which most of the silver halide, for example more than 70 mole percent, consists of silver bromide and which may be produced for example by conversion (U.S. Pat. No. 2,592,250).

Separating layers are best present between the various layer units and may contain compounds which are capable of reacting with diffusible developments products and preventing them from diffusing from one layer unit into another. This contributes towards ensuring that the particular association remains confined to one layer unit. Compounds of this type are known. Suitable compounds of this type are, for example, non-diffusing hydroquinone derivatives and, for example, the so-called scavenger compounds described in "Research Disclosure No. 17 842" (February 1979). This function may also be performed not least by ED-compounds providing they are incorporated in a separating layer between various layer units.

The interaction between the exposed silver halide and the ED-compound is generally brought about by the oxidized form of the silver halide developer used. The silver halide developer is oxidized imagewise during development and the oxidation product is in turn capable of oxidizing the ED-compound, thereby withdrawing it from the reaction with the dye releaser.

Examples of silver halide developers are hydroquinone and its derivatives, pyrocatechol and its derivatives, p-phenylene diamine derivatives and 3-pyrazolidone compounds, more particularly 1-phenyl-3-pyrazolidone, 1-phenyl-4-,4-dimethyl-3-pyrazolidone, 4-hydroxymethyl-4-methyl-1-phenyl-3-pyrazolidone, 1-phenyl-4-methyl-3-pyrazolidone, 1-phenyl-5-methyl-3-pyrazolidone, 1-phenyl-4,4-bis-(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(3-chlorophenyl)-3-pyrazolidone, 1-(4-chlorophenyl)-3-pyrazolidone, 1-(4-tolyl)-4-methyl-3-pyrazolidone, 1-(4-tolyl)-4-hydroxymethyl-4-methyl-3-pyrazolidone, 1-(3-tolyl)-3-pyrazolidone, 1-(3-tolyl)-4,4-dimethyl-3-pyrazolidone, 4-(2-trifluoroethyl)-4,4-dimethyl-3-pyrazolidone and 5-methyl-3-pyrazolidone, including 3-pyrazolidone derivatives of the type present in masked form, for example acetylated phenidone derivatives.

It is also possible to use a combination of different silver halide developers. The silver halide developers may be present in the highly viscous alkaline developer preparation or even completely or in part in one or more layers of the color photographic recording material to be processed.

Essential constituents of the aqueous developer preparation used in the process according to the invention are the alkali required for development and the combination of development accelerators according to the invention. A combination such as this contains at least one compound from each of at least two of the three groups of compounds A, B and C defined in the following.

The compounds of group A are aliphatic 1,3-diols containing from 3 to 10 carbon atoms. Typical examples are 1,3-propane diol, 1,3-butane diol, 2,2-dimethyl-1,3-propane diol, 2-methyl-2-propyl-1,3-propane diol, 2,2-diethyl-1,3-propane diol, 2-ethyl-1,3-hexane diol, 2-methyl-2,4-pentane diol, 2,2,4-trimethyl-1,3-pentane diol and 1,3-diethyl-2-methyl-1,3-propane diol.

The compounds of group B are any of the various isomers of cyclohexane dimethanol and cyclohexane dimethanol. Preferred examples are 1,2-cyclohexane dimethanol, 1,3-cyclohexane dimethanol, 1,4-cyclohexane dimethanol and 3,6-cyclohexene dimethanol.

The compounds of group C include aryl alkanols and aroxyalkanols containing a total of 7 to 12 carbon atoms, for example benzyl alcohol, 2-phenylethanol, 2-phenoxyethanol, 3-phenyl propanol and 1-phenyl-2-propanol.

Some of the above-mentioned compounds are already known as development accelerators. However, it was not known, nor had it been expected, that a combination of two of the above-mentioned compounds in the manner described above would result in an intensified development accelerating effect when used in the development of color photographic materials containing non-diffusing reducible dye releasers in combination with ED-compounds. The intensifying, or super-additive, effect is reflected in the fact that, according to the invention, a considerably smaller total of development accelerators is required for obtaining a certain, required maximum color density in a predetermined time when the development accelerators are used in the combination according to the invention by comparison with the case where only a single substance is used as the development accelerator. On the other hand, it is possible by using the combination of development accelerators according to the invention in the developer preparation to obtain a required color density more quickly than when the developer preparation contains only a single substance as the development accelerator. Another advantage of the developer preparation according to the invention lies in the fact that, individually, the various development accelerators clearly differ in the intensity of their effect upon the development of the various image-producing layer units. Thus, it is possible by varying the quantitative ratio between the individual components in the combination of development accelerators according to the invention to influence the development of one or other of the image-producing layer units to a comparatively greater extent and, in this way, better to adapt the three component color images to one another in regard to maximum color density and color gradation, so that an even color balance is more easily obtained.

The total quantity of development accelerators in the developer preparation used in accordance with the invention generally amounts to between 10 and 50 g/l. The optimal quantitative ratio between the individual components of the combination of development accelerators generally lies between 1:4 and 4:1 and may readily be determined by the expert using simple routine tests. Some development accelerators, particularly from group C, are only sparingly soluble in water. Development accelerators of this type are preferably used in quantities below their solubility concentration. Where the developer preparation according to the invention contains development accelerators from all three groups A, B and C, the third component is generally present in the combination in a concentration of less than 30% by weight and preferably in a concentration of less than 15% by weight.

In addition to the combination of development accelerators, the alkali required for development and a thickener, for example hydroxyethyl cellulose or carboxymethyl cellulose, which may be necessary for producing any required increase in viscosity, the developer preparation used in accordance with the invention may contain other additives, for example silver halide solvents, for example sodium thiosulfate, or any of the bis-sulfonyl alkyl compounds described in DE-OS No. 21 26 661, opacifiers for producing opaque layers, for example pigments of $TiO_2$, ZnO, barium sulfate, barium stearate or kaolin, or stabilizers. Alternatively or in addition, some of these constituents may even be incorporated in one or more layers of the colour photographic recording material used in accordance with the invention.

For development, the recording material exposed imagewise is treated with the described alkaline developer preparation while it is in contact with an image-receiving layer. The image-receiving layer may be arranged on a separate layer support or on the same layer support as the photosensitive layers. It may be an integral part of the photosensitive recording material or may only be brought into contact with it after exposure for the purposes of development. Depending on the design of the process, the image-receiving layer may even be separated from the originally photosensitive layers after development, for example in order to expose the dye transfer image formed for viewing purposes, or may remain in permanent contact with it, for example when the associated layer support is transparent.

A recording material suitable for carrying out the dye diffusion transfer process according to the invention comprises the following layer elements for example:

(1) a transparent layer support,
(2) an image-receiving layer,
(3) a light-impermeable layer
(4) a photosensitive element containing a blue-sensitive a green-sensitive and a red-sensitive silver halide emulsion layer and, respectively associated therewith, non-diffusing, reducible color-providing compounds and ED-compounds or ED-precursor compounds
(5) a retarding layer
(6) an acid polymer layer
(7) a transparent layer support An integral recording material may be made up by separately producing two different parts, namely a photosensitive part (layer elements 1 to 4) and a cover sheet (layer elements 5 to 7) which are then placed with their layer sides on top of one another and joined to one another, optionally using spacer strips, so that a space for accommodating an exactly measured amount of the developer preparation (in this case a paste) is formed between the two parts. The layer elements 5 and 6 which together form the neutralization system may even be arranged, albeit in reversed order, between the layer support and the image-receiving layer of the photosensitive part. Means may even be provided for introducing the developer paste between the photosensitive part and the cover sheet, for example in the form of a laterally arranged container which is designed to split open under the effect of mechanical forces to release its contents between two adjacent layers of an integral recording material of the type in question.

However, development may also be carried out with a low-viscosity liquid developer preparation (developer bath) by simple immersion treatment, particularly when the color photographic recording material contains only a single layer support which is impermeable to aqueous treatment baths.

The image-receiving layer consists essentially of a binder containing mordants for fixing the diffusible dyes released from the non-diffusing dye releasers. Preferred mordants for anionic dyes are long-chain quaternary ammonium or phosphonium compounds, for example those of the type described in U.S. Pat. Nos. 3,271,147 and 3,271,148. It is also possible to use certain metal salts and their hydroxides which form sparingly soluble compounds with the acid dyes. Reference is also made here to polymeric mordants, for example those of the type described in DE-OS No. 2,315,304, DE-OS No. 26 31 521 and DE-OS No. 29 41 818. The dye mordants are dispersed in one of the usual hydrophilic binders, for example gelatin, polyvinyl pyrrolidone, or completely or partly hydrolysed cellulose esters, in the mordant layer. Certain binders may, of course, also function as mordants, as is the case for example with copolymers or polymer mixtures of vinyl alcohol and N-vinyl pyrrolidone of the type described, for example, in DE-AS No. 1,130,284, and polymers of nitrogen-containing quaternary bases, for example polymers of N-methyl-2-vinyl pyridine, of the type described, for example, in U.S. Pat. No. 2,484,430. Other suitable mordant binders are, for example, guanyl hydrazone derivatives of alkyl vinyl ketone polymers, of the type described for example in U.S. Pat. No. 2,882,156, or guanyl hydrazone derivatives of acyl styrene polymers, of the type described for example in DE-OS No. 2,009,498. In general, however, other binders, for example gelatin, will be added to the mordant binders just mentioned.

In addition, the image-receiving layer or an adjacent layer may contain heavy metal ions, particularly copper or nickel ions, if diffusible dyes or dye precursors capable of being complexed by heavy metal ions are released during development. The metal ions may be bound in complex form in the image-receiving layer, for example bound to certain polymers, as described for example in Research Disclosure No. 18 534 (September, 1979) and in DE-OS No. 30 02 287.

If the image-receiving layer remains in layer contact with the photosensitive element, even after development has been completed, an alkali-permeable pigment-containing, light-reflecting binder layer is generally present between the image-receiving layer and the photosensitive element, serving as an optical boundary between negative and positive and as an optically attractive image background for the transferred dye image. A light-reflecting layer of this type may be preformed in the photosensitive color photographic recording material in known manner or may be produced at the development stage, again in known manner. Where the image-receiving layer is arranged between the layer support and the photosensitive element and is separated from the photosensitive element by a preformed light-reflecting layer, the layer support either has to be transparent so that the dye transfer image produced may be viewed through it, or alternatively the photosensitive element has to be removed from the image-receiving layer together with the light-reflecting layer in order to expose the image-receiving layer. However, the image-receiving layer may also be present as the uppermost layer in an integral color photographic recording material, in which case exposure is best effected through the transparent layer support.

EXAMPLE 1

A photosensitive element of a photographic recording material was produced by successively applying the following layers to a transparent support of polyethylene terephthalate. The quantities quoted are based in each case on one square meter.

1. A blue-sensitized AgBr-negative emulsion of 0.5 g of $AgNO_3$ containing 0.357 g of compound A (yellow-dye-releasing compound), 0.306 g of compound B (ED-compound), 0.663 g of palmitic acid diethylamide (oil former) and 1.06 g of gelatin.

2. A yellow filter layer containing 1.2 g of the yellow dye solvent Yellow 29 (C.I. 21230), 2.16 g of dibutyl phthalate, 0.2 g of 2-isooctadecyl-5-sulfohydroquinone and 1.2 g of gelatin.

3. A green-sensitized AgBr-negative emulsion of 0.5 g of $AgNO_3$ containing 0.35 g of compound C (magenta-dye-releasing compound), 0.223 g of compound B, 0.537 g of diethyl lauramide (oil former) and 0.9 g of gelatin.

4. An intermediate layer containing 0.2 g of 2-isooctadecyl-5-sulfohydroquinone 0.60 g of compound D (developer) and 1.0 g of gelatin.

5. A red-sensitized AgBr-negative emulsion of 0.1 g of $AgNO_3$ containing 0.30 g of compound E (cyan-dye-releasing compound), 0.16 g of compound B, 0.46 g of palmitic acid diethylamide and 0.75 g of gelatin.

6. An intermediate layer containing 0.5 g of gelatin.

7. An opaque, light-reflecting layer containing 18 g of $TiO_2$ and 2.6 g of gelatin.

8. An intermediate layer containing 4 g of gelatin.

9. An image-receiving layer containing 2.1 g of a polymeric mordant of 4,4'-diphenyl methane diisocyanate and N-ethyl diethanolamine quaternised with epichlorohydrin in accordance with DE-OS No. 26 31 521 (Example 1) and 5.2 g of gelatin.

10. A protective and hardening layer containing 1.2 g of compound F (hardener) and 0.6 g of gelatin.

Various samples of this integral recording material were exposed through the transparent support with a positive transparent original and subsequently developed by bathing for 2 minutes in activator solutions containing various quantities of accelerator. The maximum color densities shown in Table 1 were obtained after rinsing and drying:

TABLE 1

| Activator No. | KOH [g/l] | KBr [g/l] | CHDM [g/l] | MPPD [g/l] | Dmax yellow | Dmax magenta | Dmax cyan |
|---|---|---|---|---|---|---|---|
| 1 | 40 | 3 | 10 | — | 1.42 | 1.04 | 1.46 |
| 2 | " | " | 35 | — | 1.98 | 1.90 | 2.12 |
| 3 | " | " | 70 | — | 2.12 | 2.23 | 2.30 |
| 4 | " | " | — | 25 | 1.88 | 1.55 | 1.90 |
| 5 | " | " | — | 35 | 2.05 | 1.91 | 2.09 |
| 6 | " | " | — | — | 0.93 | 0.77 | 1.30 |
| 7 | " | " | 10 | 25 | 2.08 | 2.0 | 2.33 |

CHDM = 1,4-cyclohexane dimethanol
MPPD = 2-methyl-2-propyl-1,3-propane diol

Table 1 shows the following:

1. In some cases, dye transfer can be more than doubled (compare activator No. 6 with Nos. 3,5 and 7) for the same development time (2 minutes) by the addition of these accelerators.

2. Where the individual compounds are used, up to twice the quantity of mixture is required to obtain the same Dmax-values for the same development time (compare activators Nos. 3, 5 and 7).

EXAMPLE 2

A photosensitive element of a photographic recording material was prepared by successively applying the following layers to a transparent support of polyethylene terephthalate. The quantities quoted are based in each case on one square meter.

1. A blue-sensitised AgBr-negative emulsion of 0.5 g of $AgNO_3$ containing 0.357 g of compound A (yellow-dye-releasing compound), 0.306 g of compound B (ED-compoud), 0.663 g of palmitic acid diethylamide (oil former) and 1.164 g of gelatin.

2. A yellow filter layer containing 0.16 g of the yellow dye Solvent Yellow 29 (C.I. 21230), 0.2 g of 2-isooctadecyl-5-sulphohydroquinone and 1.0 g of gelatin.

3. A green-sensitised AgBr-negative emulsion of 0.5 g of $AgNO_3$ containing 0.314 g of compound C (magenta-dye-releasing compound), 0.223 g of compound B, 0.537 g of diethyl lauramide (oil former) and 1.037 g of gelatin.

4. An intermediate layer containing 0.12 g of 2-isooctadecyl-5-sulphohydroquinone, 0.60 g of compound D (developer) and 1.0 g of gelatin.

5. A red-sensitised AgBr-negative emulsion of 0.5 g of $AgNO_3$ containing 0.30 g of compound E (cyan-dye-releasing compound), 0.162 g of compound B, 0.462 g of palmitic acid diethylamide and 0.962 g of gelatin.

6. An intermediate layer containing 1.5 g of gelatin.

7. An opaque light-reflecting layer containing 18 g of $TiO_2$ and 2.57 g of gelatin.

8. An intermediate layer containing 3.6 g of gelatin.

9. An image-receiving layer containing 3.46 g of a polymeric mordant of 4,4'-diphenyl methane diisocyanate and N-ethyldiethanolamine quaternised with epichlorohydrin in accordance with DE-OS No. 26 31 521 (Example 1) and 3.46 g of gelatin.

10. A protective and hardening layer containing 1.2 g of compound F (hardener) and 0.6 g of gelatin.

The recording material was exposed through the transparent support behind a transparent original and developed with activator solutions Nos. 8 to 11 shown in Table 2. The maximum colour density Dmax and sensitivity $E_2$ values obtained are shown in Table 2.

$E_2$ is the sensitivity as measured at density 1.0 and expressed in log I·t-units (DIN).

TABLE 2

| Activator* No. | CHDM [g/l] | MPPD [g/l] | Dmax yellow | Dmax magenta | Dmax cyan | $E_2$ blue | $E_2$ green | $E_2$ red |
|---|---|---|---|---|---|---|---|---|
| 8 | 60 | — | 1.56 | 1.56 | 1.86 | 16.3 | 14.8 | 18.5 |
| | | | predetermined values | | | predetermined values | | |
| 9 | 40 | — | 1.27 | 1.05 | 1.52 | 17.8 | 18.2 | 20.0 |
| 10 | — | 35 | 1.45 | 1.42 | 1.83 | 14.4 | 13.7 | 17.8 |
| 11 | 40 | 10 | 1.56 | 1.60 | 1.83 | 16.0 | 14.6 | 18.3 |

*KOH = 40 g/l
KBr = 1.5 g/l

The results show another advantage of the invention, namely:

Since the two accelerators accelerate transfer of the individual dyes to different extents, it is possible, by suitably graduating the mixing ratio, exactly to adjust the maximum density and sensitivity values to a certain predetermined value and at the same time to reduce the total quantity of accelerator (compare activators Nos. 8 and 11).

EXAMPLE 3

Another accelerator combination which, in principle, has the same advantages in terms of mixing is the mixture of 1,4-cyclohexane dimethanol and 2,2-diethyl-1,3-propane diol (=DEPD).

In this case, too, higher Dmax-values are obtained in admixture than with the same quantities of the individual products, as shown in Table 3.

TABLE 3

| Activator* | CHDM | DEPD | Dmax | | | $E_2$ | | |
|---|---|---|---|---|---|---|---|---|
| No. | [g/l] | [g/l] | yellow | magenta | cyan | blue | green | red |
| 12 | 60 | — | 2.05 | 2.10 | 2.20 | 12.1 | 10.8 | 17.3 |
| 13 | — | 50 | 2.09 | 1.94 | 2.08 | 11.0 | 10.8 | 15.6 |
| 14 | 20 | 25 | 2.16 | 2.09 | 2.25 | 11.7 | 10.8 | 17.0 |

*40 g KOH/l
3 g KBr/l

EXAMPLE 4

Further accelerator mixtures having the advantages according to the invention are shown in Table 4, the recording material used being the integral recording material described in Example 1.

TABLE 4

| CHDM | MPPD | DEPD | TMPD | PhOE | Dmax | | | $E_2$ | | |
|---|---|---|---|---|---|---|---|---|---|---|
| [g/l] | [g/l] | [g/l] | [g/l] | [g/l] | yellow | magenta | cyan | blue | green | red |
| 10 | 25 | — | — | — | 2.08 | 2.00 | 2.33 | 11.6 | 9.9 | 15.1 |
| — | 25 | — | — | 10 | 2.09 | 2.01 | 2.18 | 12.3 | 10.0 | 16.5 |
| | 30 | — | 12 | 3 | 2.06 | 2.06 | 2.18 | 11.2 | 9.8 | 15.8 |
| 5 | 25 | — | — | 10 | 2.04 | 1.94 | 2.09 | 12.5 | 9.8 | 17.5 |

40 g of KOH/l + 3 g of KBr/l
PhOE = 2-phenoxy ethanol
TMPD = 2,2,4-trimethyl-1,3-pentane diol

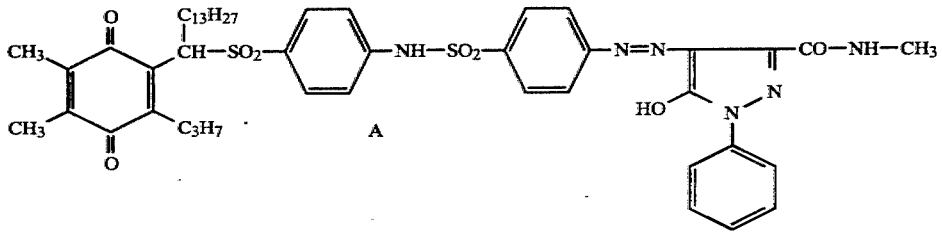

A

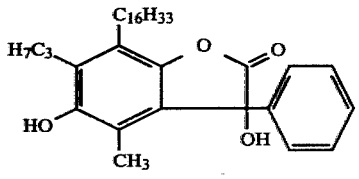

B

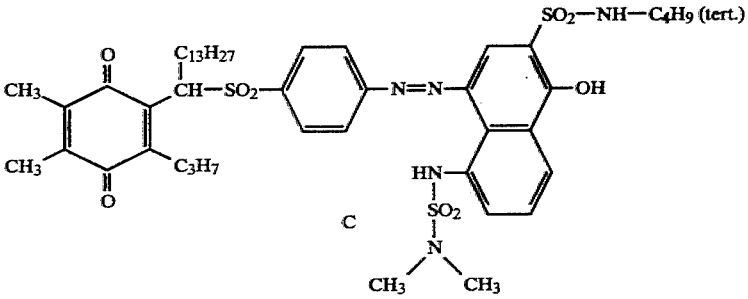

C

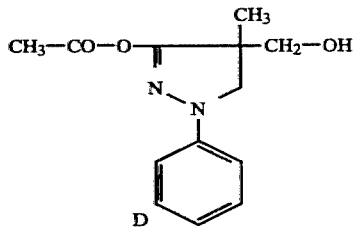

D

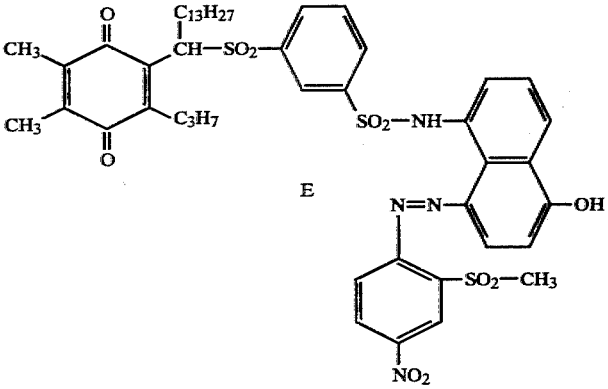

E

-continued

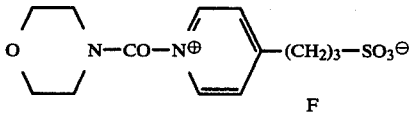

F

I claim:

1. A process for the production of colored images by the dye diffusion transfer process in which an image-wise exposed color photographic recording material, comprising at least one photosensitive silver halide emulsion layer and, associated therewith, a non-diffusing color-providing compound, is developed in surface-to-surface contact with an image-receiving layer using a developer preparation containing a development accelerator, wherein the improvement comprises 1. the color photographic recording material used is one which contains, in association with at least one negative silver halide emulsion layer, a combination of a non-diffusing reducible color providing compound and an ED-compound, and
2. the developer preparation used is one which contains, as development accelerator, a combination of two of the compounds A and B or a combination of a compound C with at least one compound of A and B defined in the following of which A is an aliphatic 1,3-diol selected from the group consisting of 1,3-propane diol, 1,3-butane diol, 2,2-dimethyl-1,3-propane-diol, 2-methyl-2-propyl-1,3-propane diol, 2,2-diethyl-1,3-propane diol, 2-ethyl-1,3-hexane diol, 2-methyl-2,4-pentane diol, 2,2,4-trimethyl-1,3-pentane diol and 1,3-diethyl-2-methyl-1,3-propane diol, B is 1,4-cyclohexane dimethanol, and C is phenoxyethanol.

2. A recording material as claimed in claim 1, wherein the color-providing compound used corresponds to the following formula

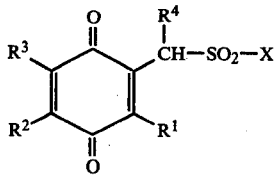

in which

X represents the residue of a diffusible dye or dye precursor, $R^1$, $R^2$ and $R^3$ represent hydrogen, halogen, alkyl, alkoxy, aryl or acylamino, or $R^2$ and $R^3$ complete a fused ring, $R^4$ represents hydrogen or alkyl, at least one of the radicals $R^1$, $R^2$, $R^3$ and $R^4$ containing a radical which imparts resistance to diffusion.

3. A process as claimed in claim 1 wherein the developer preparation contains cyclo hexane-1,4-dimethanol in combination with 2,2-diethyl-1,3-propane diol, 2-methyl-2-propyl-1,3-propane diol or 2,2,4-trimethyl-1,3-propane diol.

4. A process as claimed in claim 1 wherein the developer preparation contains 2-phenoxy ethanol in combination with 2,2-diethyl-1,3-propane diol, 2-methyl-2-propyl-1,3-propane diol or 2,2,4-trimethyl-1,3-propane diol.

* * * * *